US006821163B2

(12) United States Patent
McHugh et al.

(10) Patent No.: US 6,821,163 B2
(45) Date of Patent: Nov. 23, 2004

(54) ELECTRICAL CONNECTOR HAVING TERMINALS WITH RELIABLE RETENTION PROTRUSIONS

(75) Inventors: Robert G. McHugh, Golden, CO (US); Fang-Chu Liao, Tu-chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/375,580

(22) Filed: Feb. 25, 2003

(65) Prior Publication Data

US 2004/0166703 A1 Aug. 26, 2004

(51) Int. Cl.[7] ..... H01R 13/40
(52) U.S. Cl. ..... 439/733.1; 439/71; 439/66
(58) Field of Search ..... 439/733.1, 71, 439/66

(56) References Cited

U.S. PATENT DOCUMENTS 5,641,314 A * 6/1997 Broschard et al. ..... 439/751
5,984,693 A * 11/1999 McHugh et al. ..... 439/66
6,139,373 A * 10/2000 Ward et al. ..... 439/733.1
6,165,027 A * 12/2000 Huang et al. ..... 439/752.5
6,206,719 B1 * 3/2001 Tsunezawa et al. ..... 439/395
6,296,495 B1 * 10/2001 Wang et al. ..... 439/71
6,454,615 B1 * 9/2002 Yu ..... 439/752.5

* cited by examiner

*Primary Examiner*—Gary Paumen
(74) *Attorney, Agent, or Firm*—Wei Te Chung

(57) ABSTRACT

An electrical connector (1) includes a housing (6), and terminals (2) received in passageways (60) of the housing. Each passageway includes a retention space (602) that is bounded by a forward wall (6022), two side walls (6021) and two rearward walls. Each terminal includes a vertical retention portion (24) having a first main face (242), a second main face (244) and a pair of side faces (243). A retention protrusion (26) extends outwardly from each of opposite sides of the retention portion, and then bends perpendicularly. In one embodiment, the protrusions protrude beyond both the side faces and the second main face. Each protrusion includes a first interference portion (260) interferentially engaging with the respective side walls of a corresponding passageway, and a second interference portion (262) interferentially engaging with the forward wall. Each protrusion has a reinforced structure, and the terminal is securely and reliably retained in the passageway.

3 Claims, 6 Drawing Sheets

ELECTRICAL CONNECTOR HAVING TERMINALS WITH RELIABLE RETENTION PROTRUSIONS

BACKGROUND OF THE INVENTION

1. Field of the Invention

The present invention relates to an electrical connector for electrically connecting an electronic package such as a land grid array (LGA) chip with a circuit substrate such as a printed circuit board (PCB), and particularly to an electrical connector with terminals each having a plurality of retention protrusions.

2. Description of the Prior Art

Land grid array (LGA) connectors are widely used in personal computer (PC) systems to electrically connect LGA chips with PCBs. An LGA connector comprises a multiplicity of terminals arranged in a rectangular array. Each terminal has a first contact portion soldered to a PCB, and a second contact portion depressed by and engaging with a corresponding contact pad of an LGA chip. Thus the chip and the PCB are electrically connected by the connector.

China Pats. Nos. ZL95223360.6 and ZL0221158.3, and U.S. Pats. Nos. 6,296,495 and 5,984,693 each disclose a conventional terminal of an LGA electrical connector. Referring to FIG. 8, U.S. Pat. No. 6,296,495 discloses a terminal 5 of an LGA electrical connector. The terminal 5 is stamped from a resilient metal strip. The terminal 5 comprises a horizontal soldering base 50, for soldering the terminal 5 to a circuit pad of a PCB (not shown) and thereby electrically connecting the terminal 5 with the PCB. The soldering base 50 has a rear end 501 and a front end 503. An upper spring arm 52 extends upwardly and forwardly from a rear end 501 of the soldering base 50. The spring arm 52 has a curved top contact portion 521 for engaging with a plate-like contact pad of an LGA chip (not shown) when the LGA chip is pressed against the LGA electrical connector. Thus, the terminal 5 electrically connects the LGA chip with the PCB. A lower beam 54 upwardly and forwardly extends from a front end 503 of the soldering base 50. A vertically oriented junction portion 56 extends from a front end of the lower beam 54. An upper section of the junction portion 56 is bifurcated, and forms a pair of retention arms 561. The lower contact beam 54 and the junction portion 56 are integrally joined between the retention arms 561. A multiplicity of barbs 562 is respectively formed on opposite vertical side edges of the junction portion 56, for interferentially fixing the terminal 5 in an insulative housing (not shown).

However, the barbs 562 are so thin that the terminal 5 is liable to sustain deformation in assembly of the LGA electrical connector. In addition, the horns of the barbs 562 are prone to scrape inner surfaces of a corresponding passageway of a housing (not shown) of the LGA electrical connector, resulting in the terminal 5 not being securely fastened in the passageway. These contingencies can lead to failure of electrical connection between the LGA chip and PCB.

A new LGA electrical connector which overcomes the above-mentioned problems is desired.

SUMMARY OF THE INVENTION

An object of the present invention is to provide an electrical connector having terminals securely fixed in a housing thereof.

In order to achieve the above object, an electrical connector in accordance with the present invention comprises an insulative housing and a plurality of terminals. The housing defines a plurality of passageways receiving the terminals therein. Each passageway comprises a retention space that is bounded by a forward wall, a pair of side walls and a pair of rearward walls. Each terminal comprises a vertical retention portion, and a connection beam extending from the retention portion. The connection beam has a first contact portion for soldering the terminal to a circuit substrate. A spring arm extends upwardly from the first contact portion. The spring arm defines a curved second contact portion. The retention portion comprises a first main face, a second main face, and a pair of side faces. A retention protrusion extends outwardly from each of opposite sides of the retention portion, and then bends perpendicularly.

In a first preferred embodiment of present invention, the protrusions protrude beyond both the side faces and the second main face of the retention portion. Each protrusion comprises a first interference portion parallel to the respective side face, and a second interference portion parallel to the second main face. The first interference portions of the protrusions interferentially engage with the respective side walls of the corresponding passageway, and the second interference portions of the protrusions interferentially engage with the forward wall of the passageway. The protrusions each have a reinforced structure, and the terminal is securely and reliably retained in the passageway. Second and third preferred embodiments of the present invention are also shown and described.

Other objects, advantages and novel features of the present invention will become more apparent from the following detailed description when taken in conjunction with the accompanying drawings, in which:

DESCRIPTION OF THE PREFERRED EMBODIMENTS

Reference will now be made to the drawings to describe the present invention in detail.

Figure 1:
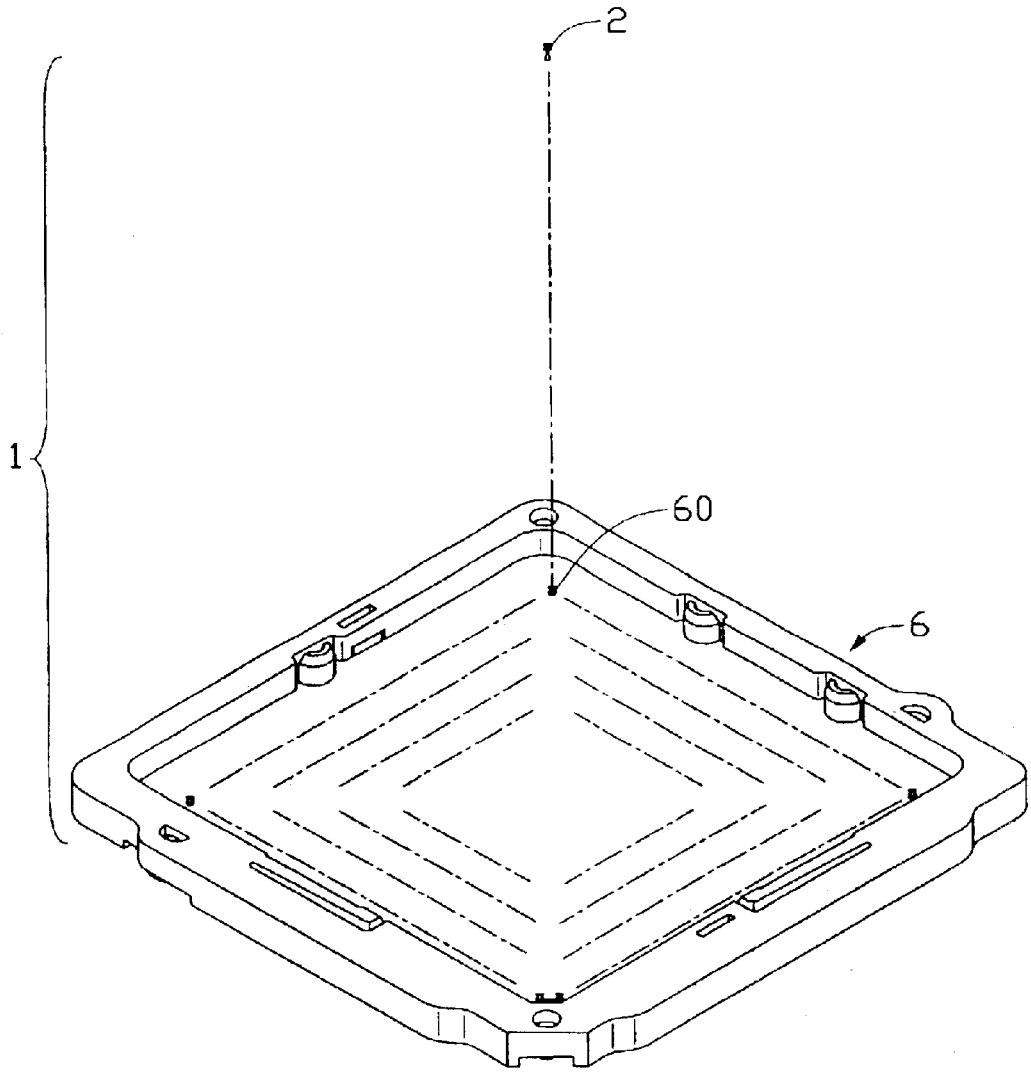
FIG. 1 is a simplified, exploded perspective view of an electrical connector in accordance with a first preferred embodiment of the present invention.

Referring to FIG. 1, an LGA electrical connector 1 in accordance with a first preferred embodiment of the present invention comprises an insulative housing 6, and a multiplicity of terminals 2 received in a multiplicity of passageways 60 of the housing 6, respectively.

Figure 2:
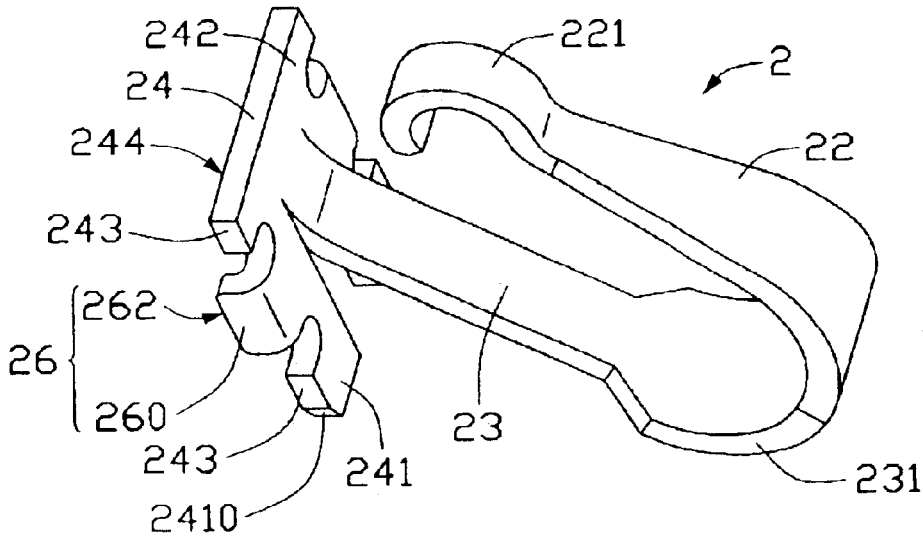
FIG. 2 is an enlarged, isometric view of a terminal, of the electrical connector in accordance with the first preferred embodiment of the present invention.

Referring to FIG. 2, each terminal 2 is stamped from a sheet of conductive metallic material, and comprises a connection beam 23. The connection beam 23 defines a rear first contact portion 231, for soldering the terminal 2 to a circuit pad of a PCB (not shown) and thereby electrically connecting the terminal 2 with the PCB. An upper spring arm 22 extends upwardly and forwardly from the first contact portion 231 of the connection beam 23. The spring arm 22 has a distal curved second contact portion 221, for engaging with a plate-like contact pad of an LGA chip (not shown) when the LGA chip is pressed against the LGA electrical connector 1. Thereby, the terminal 2 electrically connects the LGA chip with the PCB. A vertical retention portion 24 extends from a front end of the connection beam 23. The retention portion 24 comprises a pair of retention arms 241 depending from respective opposite sides of a junction of the retention portion 24 with the connection beam 23. A pair of chamfers 2410 is formed at outer bottom corners of the retention arms 241 respectively, for facilitating insertion of the terminal 2 into a corresponding passageway 60 of the housing 6. The retention portion 24 also comprises a first main face 242 proximate to the connection beam 23, a second main face 244 distal from the connection beam 23, and a pair of opposite side faces 243 respectively interconnecting the first main face 242 and the second main face 244. Each side face 243 is bifurcated, the two parts of the side face 243 being separated by an interposing retention protrusion 26 as described in more detail below.

Each terminal 2 comprises a pair of the protrusions 26 at respective opposite sides thereof, for interferentially fixing the terminal 2 in the corresponding passageway 60 of the housing 6. Each protrusion 26 extends outwardly from a respective side of the retention portion 24, and then bends perpendicularly forwardly. The protrusion 26 protrudes beyond both the side face 243 and the second main face 244. The protrusion 26 comprises a flat outer first interference portion 260 parallel to the side face 243, and an adjacent flat distal second interference portion 262 parallel to the second main face 244. The second interference portions 262 of the protrusions 26 are located at a same front side of the retention portion 24. A junction of each protrusion 26 and its side of the retention portion 24 is relatively long compared with the overall size of the protrusion 26. In addition, the protrusion 26 is bent. Thus a structure of the protrusion 26 is reinforced.

Figure 5:
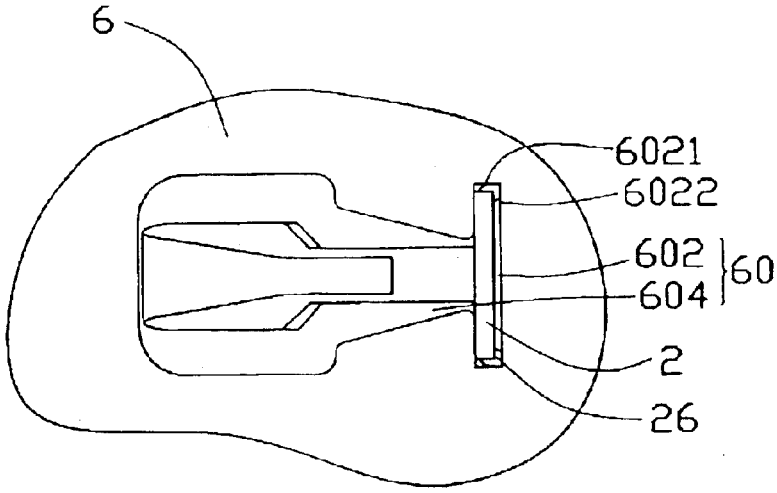
FIG. 5 is an enlarged, top elevation view of part of a housing of the electrical connector of the first preferred embodiment of the present connector in, showing a corresponding terminal received in a passageway of the housing.

Referring to FIG. 5, each passageway 60 of the housing 6 has a generally T-shaped profile. The passageway 60 comprises a receiving hole 604, and a retention space 602 in communication with one end of the receiving hole 604. The receiving hole 604 receives a main part of the terminal 2, and the retention space 602 interferentially receives the retention portion 24 of the terminal 2. The retention space 602 is bounded by a forward wall 6022, a pair side walls 6021 respectively adjacent the forward wall 6022 and being perpendicular thereto, and a pair of rearward walls respectively adjacent the side walls 6021 and being parallel to the forward wall 6022. The first interference portions 260 of the protrusions 26 of the terminal 2 interferentially engage with the side walls 6021 respectively. The second interference portions 262 of the protrusions 26 interferentially engage with the forward wall 6022. The first main face 242 of the retention portion 24 fittingly abuts the rearward walls. Therefore, the terminal 2 is interferentially received in the passageway 60 of the housing 6, and is secured in directions both parallel to and perpendicular to the retention portion 24. Because the first and second interference portions 260, 262 of the protrusions 26 are each flat, they do not unduly scrape the forward and side walls 6022, 6021 at the retention space 602 in assembly. Because the structures of the protrusions 26 are reinforced, the terminal 2 resists distortion in assembly and thereafter. Thus, the terminal 2 is securely and reliably retained in the passageway 60. Accordingly, signal transmission between the LGA chip and the PCB is stable and reliable.

Figure 3:
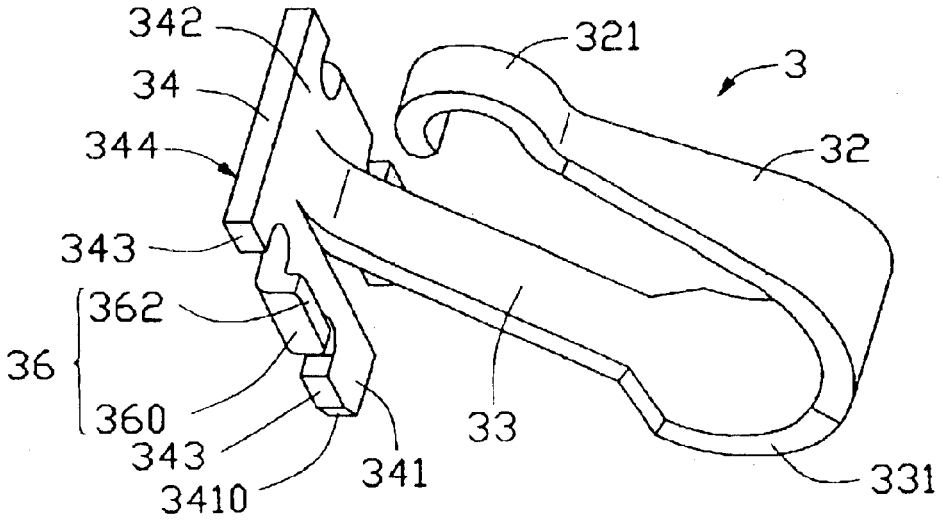
FIG. 3 is an isometric view of a terminal of an electrical connector in accordance with a second preferred embodiment of the present invention.

FIG. 3 shows a terminal 3 in accordance with a second preferred embodiment of the present invention. The terminal 3 has a structure similar to that of the terminal 2 of the first preferred embodiment. The terminal 3 comprises a connection beam 33, an upper spring arm 32 extending upwardly and forwardly from a first contact portion 331 of the connection beam 33, and a vertical retention portion 34 extending from a front end of the connection beam 33. The spring arm 32 has a curved second contact portion 321. The retention portion 34 comprises a pair of retention arms 341 having a pair of chamfers 3410. The retention portion 34 also comprises a first main face 342, a second main face 344, and a pair of side faces 343. Each side face 343 is bifurcated, the two parts of the side face 343 being separated by an interposing retention protrusion 36. Each protrusion 36 protrudes beyond the side face 343. One of the protrusions 36 protrudes beyond the second main face 344, and the other protrusion 36 protrudes beyond the first main face 342. Each protrusion 36 comprises a first interference portion 360 and a second interference portion 362. The second interference portions 362 of the protrusions 36 are respectively located at rear and front sides of the retention portion 34. The terminal 3 has similar characteristics and performs functions similar to those of the terminal 2 of the first preferred embodiment.

Figure 6:
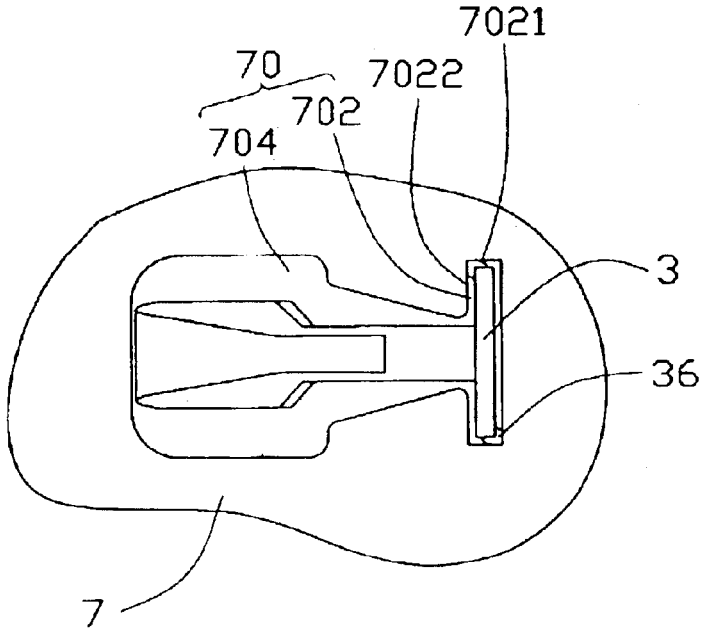
FIG. 6 is a top elevation view of part of a housing of an electrical connector in accordance with the second preferred embodiment of the present invention, showing a corresponding terminal received in a passageway of the housing.

Referring to FIG. 6, each of passageways 70 of an insulative housing 7 according to the second preferred embodiment of the present invention has a configuration similar to that of each passageway 60 described above in relation to the first preferred embodiment. Each passageway 70 comprises a receiving hole 704 receiving a main part of the terminal 3, and a retention space 702 interferentially receiving the retention portion 34 of the terminal 3. The retention space 702 is bounded by a forward wall, a pair of side walls 7021, and a pair of rearward walls 7022. The first interference portions 360 of the protrusions 36 of the terminal 3 interferentially engage with the side walls 7021 respectively. The second interference portions 362 of the protrusions 36 interferentially engage respectively with the forward wall and one of the rearward walls 7022. The passageway 70 has similar characteristics and performs functions similar to those of the passageway 60 of the first preferred embodiment.

Figure 4:
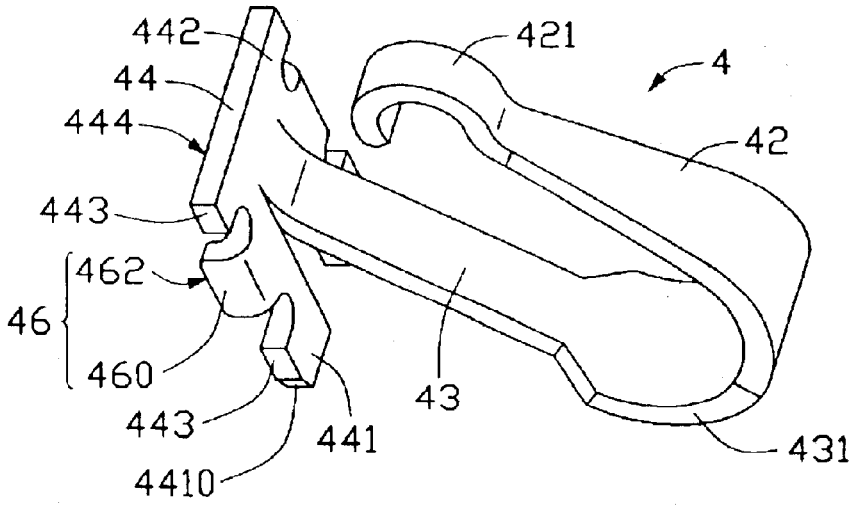
FIG. 4 is an isometric view of a terminal of an electrical connector in accordance with a third preferred embodiment of the present invention.

FIG. 4 shows a terminal 4 in accordance with a third preferred embodiment of the present invention. The terminal 4 has a structure similar to that of the terminal 2 of the first preferred embodiment. The terminal 4 comprises a connection beam 43, an upper spring arm 42 extending upwardly and forwardly from a first contact portion 431 of the connection beam 43, and a vertical retention portion 44 extending from a front end of the connection beam 43. The spring arm 42 has a curved second contact portion 421. The retention portion 44 comprises a pair of retention arms 441 having a pair of chamfers 4410. The retention portion 44 also comprises a first main face 442, a second main face 444, and a pair of side faces 443. Each side face 443 is bifurcated, the two parts of the side face 443 being separated by an interposing retention protrusion 46. Each protrusion 46 extends outwardly from a respective side of the retention portion 44, and then bends perpendicularly forwardly. The protrusion 46 does not protrude beyond the side face 443 of the retention portion 44, but protrudes beyond the second main face 444. Each protrusion 46 comprises a first interference portion 460, and a second interference portion 462. The first interference portions 460 of the protrusions 46 are substantially coplanar with the respective side faces 443 of the retention portion 44. The second interference portions 462 of the protrusions 46 are located at a same front side of the retention portion 44. The terminal 4 has similar characteristics and performs functions similar to those of the terminal 2 of the first preferred embodiment.

Figure 7:
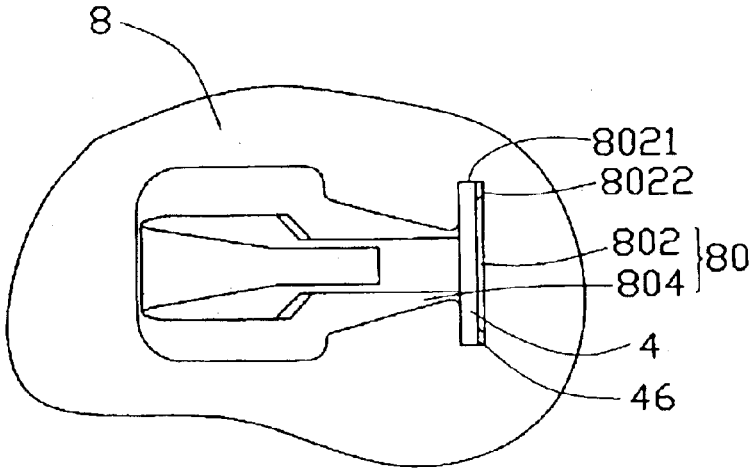
FIG. 7 is a top elevation view of part of a housing of an electrical connector in accordance with the third preferred embodiment of the present invention, showing a corresponding terminal received in a passageway of the housing.
Figure 8:
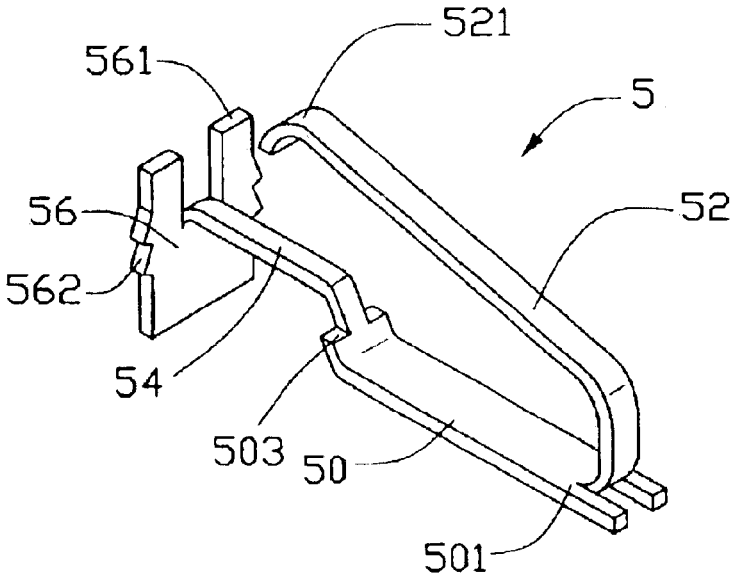
FIG. 8 (PRIOR ART)
FIG. 8 is an isometric view of a conventional terminal of an electrical connector.

Referring to FIG. 7, each of passageways 80 of an insulative housing 8 according to the third preferred embodiment of the present invention has a configuration similar to that of each passageway 60 described above in relation to the first preferred embodiment. Each passageway 80 comprises a receiving hole 804 receiving a main part of the terminal 4, and a retention space 802 interferentially receiving the retention portion 44 of the terminal 4. The retention space 802 is bounded by a forward wall 8022, a pair of side walls 8021, and a pair of rearward walls. The first interference portions 460 of the protrusions 46 interferentially engage with the side walls 8021 respectively. The second interference portions 462 of the protrusions 46 interferentially engage with the forward wall 8022. The first surface 442 of the retention portion 44 fittingly abuts the rearward walls. The passageway 80 has similar characteristics and performs functions similar to those of the passageway 60 of the first preferred embodiment.

While preferred embodiments in accordance with the present invention have been shown and described, equivalent modifications and changes known to persons skilled in the art according to the spirit of the present invention are considered within the scope of the present invention as defined in the appended claims.

What is claimed is:

1. An electrical connector for electrically connecting an electrical package with a circuit substrate, the electrical connector comprising:

a insulative housing defining a plurality of passageways therein; and a plurality of terminals received in the passageways, each of the terminals comprising a retention portion and a retention protrusion extending from the retention portion, the retention portion comprising a first main face, a second main face, and a pair of side faces;

wherein the protrusion protrudes beyond the second main face and a respective side face, whereby the terminal can be securely received in a corresponding passageway;

wherein the protrusion extends perpendicularly from a respective side of the retention portion;

wherein the protrusion comprises a first interference portion protruding beyond the respective side face, and a second interference portion protruding beyond the second main face;

wherein the second interference portion is located at a same side of the retention portion corresponding to the second main face;

wherein the protrusion comprises a first interference portion substantially coplanar with the respective side face, and a second interference portion protruding beyond the second main face;

wherein each of the terminals further comprises a connection beam connecting with the retention portion and having a first contact portion, and a spring arm extending from the connection beam and having a second contact portion.

2. An electrical connector for electrically connecting an electronic package with a circuit substrate, the electrical connector comprising:

an insulative housing defining a plurality of passageways therein, each of the passageways comprising a retention space bounded by a first wall, a pair of side walls, and a pair of second walls; and a plurality of terminals received in the passageways, each of the terminals comprising a retention portion and a plurality of retention protrusions extending from the retention portion, the retention portion comprising a first main face, a second a face, and a pair of side faces, each of the protrusions comprising a first interference portion and a second interference portion;

wherein each of the protrusions of each of the terminals protrudes beyond the second main face and beyond a respective side face of the retention portion, the first interference portions of the protrusions interferentially engage with the side walls of a corresponding passageway, and the second interference portions of the protrusions interferentially engage with any one or more of the first and second walls of the corresponding passageway respectively, whereby the terminal can be securely received in the corresponding passageway;

wherein each of the protrusions extends from a respective side of the retention portion, and then bends perpendicularly;

wherein the second interference portions of the protrusions are located at a same side of the retention portion corresponding to the second main face;

wherein each of the passageways has a generally T-shaped profile, and further comprises a receiving hole in communication with the retention space;

wherein each of the terminals further comprises a connection beam connecting with the retention portion and having a first contat portion, and a spring arm extending from the connection beam and having a second contact portion.

3. An electrical connector for electrically connecting an electronic package with a circuit substrate, the electrical connector comprising:

an insulative housing defining a plurality of passageways therein; and a plurality of terminals received in the passageways, each of the terminals comprising a retention portion having a first main face and a second main face, a plurality of retention protrusions extending from and bending angularly relative to the retention portion;

wherein each of the protrusions of each of the terminals protrudes beyond the second main face, whereby the terminal can be securely received in a corresponding passageway;

wherein the retention portion further has a pair of sides;

wherein each of the protrusions bends perpendicularly from a respective side of the retention portion to beyond the second main face;

wherein the protrusions are located at a same side of the retention portion corresponding to the second main face;

wherein each of the terminals further comprises a connection beam connecting with the retention portion and having a first contact portion, and a spring arm extending from the connection beam and having a second contact portion;

wherein each of the passageways includes a large receiving hole and a small retention space in communication with one end of said receiving hole, said end being narrower, in a lengthwise direction of the retention space, than the retention space, and the corresponding terminal including a connection beam extending from the retention portion, away from the retention space, and through said end into the receiving hole.

* * * * *